US012516461B2

(12) United States Patent
Roetker

(10) Patent No.: US 12,516,461 B2
(45) Date of Patent: Jan. 6, 2026

(54) SANITIZING RINSE IN A WASHING MACHINE APPLIANCE

(71) Applicant: Haier US Appliance Solutions, Inc., Wilmington, DE (US)

(72) Inventor: John J. Roetker, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 224 days.

(21) Appl. No.: 18/310,918

(22) Filed: May 2, 2023

(65) Prior Publication Data

US 2024/0368817 A1 Nov. 7, 2024

(51) Int. Cl.

| | |
|---|---|
| ***D06F 33/38*** | (2020.01) |
| ***D06F 23/02*** | (2006.01) |
| ***D06F 33/36*** | (2020.01) |
| ***D06F 33/37*** | (2020.01) |
| ***D06F 34/05*** | (2020.01) |
| ***D06F 34/28*** | (2020.01) |
| ***D06F 39/02*** | (2006.01) |
| ***D06F 39/08*** | (2006.01) |
| *D06F 105/42* | (2020.01) |
| *D06F 105/52* | (2020.01) |
| *D06F 105/58* | (2020.01) |

(52) U.S. Cl.

CPC ..... *D06F 33/38* (2020.02); *D06F 23/02* (2013.01); *D06F 33/36* (2020.02); *D06F 33/37* (2020.02); *D06F 34/05* (2020.02); *D06F 34/28* (2020.02); *D06F 39/02* (2013.01); *D06F 39/085* (2013.01); *D06F 39/088* (2013.01); *D06F 2105/42* (2020.02); *D06F 2105/52* (2020.02); *D06F 2105/58* (2020.02)

(58) Field of Classification Search

None

See application file for complete search history.

(56) References Cited

U.S. PATENT DOCUMENTS

| | | | |
|---|---|---|---|
| 3,702,069 | A | 11/1972 | Sharpe |
| 8,202,373 | B2 | 6/2012 | Holzman et al. |
| 8,490,440 | B2 | 7/2013 | Aykroyd et al. |
| 11,280,039 | B2 | 3/2022 | Roetker |
| 2006/0130533 | A1 | 6/2006 | Ooe et al. |

(Continued)

FOREIGN PATENT DOCUMENTS

| | | |
|---|---|---|
| EP | 2050854 B1 | 3/2011 |

*Primary Examiner* — Cristi J Tate-Sims

(74) *Attorney, Agent, or Firm* — Dority & Manning, P.A.

(57) ABSTRACT

A washing machine appliance has a drum positioned within a tub. The drum defines a wash chamber for receipt of articles for washing and sanitizing. A method of operating the washing machine appliance includes, in a rinse cycle, filling the tub with a first volume of water to the tub at a temperature provided between a predetermined range, adding a volume of sanitizing additive to the tub, and performing an agitation cycle for a predetermined time period. The first volume of water and the sanitizing additive are mixed during the first agitation cycle to form a sanitizing liquor. The rinse cycle further includes draining the sanitizing liquor from the tub after performing the agitation cycle and performing an extraction cycle after draining the sanitizing liquor from the tub. As a result, the washing machine appliance and articles therein are sanitized.

18 Claims, 8 Drawing Sheets

(56) References Cited

U.S. PATENT DOCUMENTS

| | | | | |
|---|---|---|---|---|
| 2008/0276655 | A1* | 11/2008 | Luckman | D06F 33/00 68/12.12 |
| 2016/0201247 | A1 | 7/2016 | Roetker | |
| 2017/0022648 | A1 | 1/2017 | Roetker | |
| 2020/0385910 | A1* | 12/2020 | Roetker | D06F 35/006 |

* cited by examiner

SANITIZING RINSE IN A WASHING MACHINE APPLIANCE

FIELD OF THE INVENTION

The present subject matter relates generally to washing machine appliances and methods for washing articles therein, and particularly to the sanitization of articles during washing thereof.

BACKGROUND OF THE INVENTION

Washing machine appliances generally include a cabinet which supports a tub for containing wash fluid, e.g., water and detergent, bleach and/or other wash additives. A basket is mounted within the tub and defines a wash chamber for receipt of articles for washing. During operation of such washing machine appliances, wash fluid is directed into the tub and onto articles within the wash chamber of the basket. The basket or an agitation element can rotate at various speeds to agitate articles within the wash chamber in the wash fluid, to wring wash fluid from articles within the wash chamber, etc.

Many washing machine appliances utilize sanitization cycles for generally sanitizing articles being washed therein. Historically, sanitization cycles utilized thermal sanitization, heating water in the tub to relatively high temperatures for prolonged time periods to sanitize articles within the tub. However, such approaches are both energy and time intensive.

More recently, various additives in combination with specifically tailored sanitization cycles have been utilized to sanitize articles. For example, the use of additives with multiple hot water fills and multiple prolonged agitation periods for sanitization purposes. However, the requirements of multiple hot water fills and multiple prolonged agitation periods still require undesirably high energy usage.

An additional issue with presently known sanitization cycles is that the high temperature water utilized in such cycles can have an undesirable effect on some stains, such as blood. Rather than assisting in removing such stains from articles in the tub, the high temperature water can lock-in the stain.

Accordingly, improved washing machine appliances and methods for washing articles which provide improved sanitization cycles would be advantageous. In particular, improved sanitization at reduced energy levels would be desired.

BRIEF DESCRIPTION OF THE INVENTION

Aspects and advantages of the invention will be set forth in part in the following description, or may be apparent from the description, or may be learned through practice of the invention.

In accordance with one embodiment of the present disclosure, a method of operating a washing machine appliance is provided. The washing machine appliance may have a drum positioned within a tub, the drum defining a wash chamber for receipt of articles for sanitizing. The method may include performing a sanitization rinse operation. The sanitization rinse operation may include supplying a first volume of water to the articles for sanitizing within the tub at a temperature of between 33 degrees Fahrenheit and 100 degrees Fahrenheit; adding a sanitizing additive to the tub, the sanitizing additive being added concurrently with or after providing the first volume of water to the tub to create a concentration of sanitizing additive within the first volume of water; performing a first agitation cycle for a first predetermined time period after providing the first volume of water and adding the sanitizing additive to the tub, wherein the first volume of water and the sanitizing additive are mixed during the first agitation cycle to form a sanitizing liquor; supplying an additional additive to the tub after performing the first agitation cycle; performing a second agitation cycle after supplying the additional additive to the tub; draining the tub after performing the second agitation cycle; and performing an extraction cycle after draining the tub.

In accordance with another embodiment of the present disclosure, a method of operating a washing machine appliance is provided. The washing machine appliance may include a drum positioned within a tub, the drum defining a wash chamber for receipt of articles for washing and sanitizing. The method may include performing a sanitization rinse operation. The sanitization rinse operation may include supplying a first predetermined volume of water to the tub via a spray pattern from a water supply; adding a predetermined volume of sanitizing additive to the tub to create a predetermined concentration of sanitizing additive within the first predetermined volume of water, the predetermined concentration being between 2 milliliters and 50 milliliters of sanitizing additive per liter of water; performing a first agitation cycle for a predetermined time period after filling the tub with the first predetermined volume of water and adding the predetermined volume of sanitizing additive to the tub, wherein the predetermined volume of water and the predetermined volume of sanitizing additive are mixed during the first agitation cycle to form a sanitizing liquor; draining the sanitizing liquor from the tub after performing the first agitation cycle; and performing an extraction cycle after draining the sanitizing liquor from the tub; whereby the washing machine appliance and articles therein are sanitized; and performing a dilution rinse operation following the sanitization rinse operation. The dilution rinse operation may include supplying a second predetermined volume of water to the tub; performing a second agitation cycle for a predetermined time period; draining the second predetermined volume of water from the tub after performing the second agitation cycle; and performing an extraction cycle after draining the second predetermined volume of water from the tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
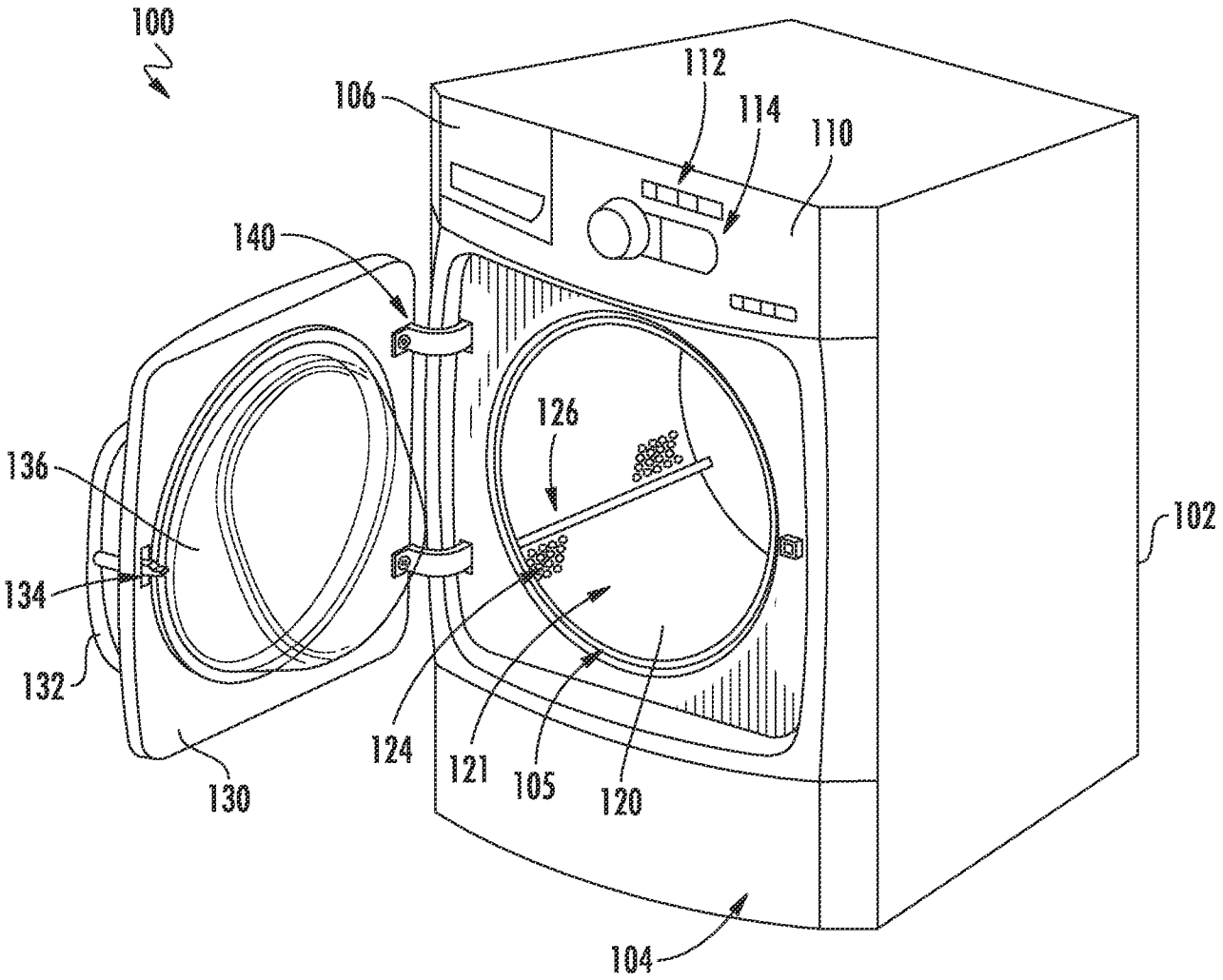
FIG. 1 provides a perspective view of an example washing machine appliance in accordance with one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary horizontal axis front load washing machine appliance 100. A drum 120 of washing machine appliance 100 rotates about a substantially horizontal axis. Thus, washing machine appliance 100 is generally referred to as a horizontal axis washing machine appliance 100. However, while described in the context of washing machine appliance 100, using the teachings disclosed herein, it will be understood that washing machine appliance 100 is provided by way of example only. Other washing machine appliances having different configurations, different appearances, and/or different features may also be utilized with the present subject matter as well, such as vertical axis washing machine appliances.

Figure 2:
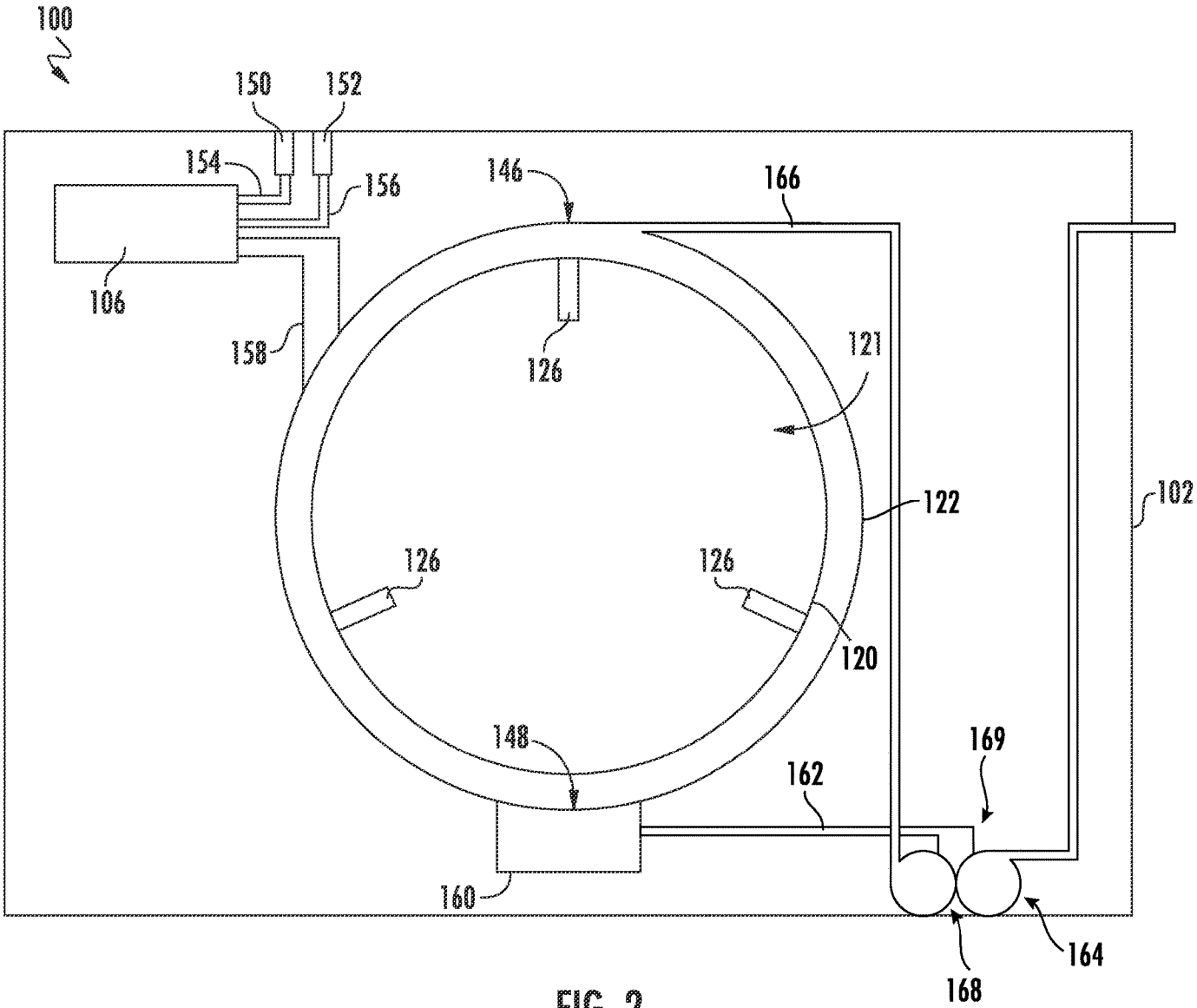
FIG. 2 provides a schematic view of the example washing machine appliance of FIG. 1.

Washing machine appliance 100 has a cabinet 102 with a tub 122 mounted therein. Tub 122 is configured for containing wash fluid during operation of washing machine appliance 100. Drum 120 is rotatably mounted within tub 122. Drum 120 extends between a top portion 146 (FIG. 2) and a bottom portion 148 (FIG. 2). Top and bottom portions 146 and 148 of drum 120 are, e.g., vertically, spaced apart from each other. A motor may be in mechanical communication with drum 120 in order to selectively rotate drum 120 (e.g., during an agitation, a spin, or a tumble cycle of washing machine appliance 100). Drum 120 defines a wash chamber 121 that is configured for receipt of articles for washing. Ribs 126 may extend from drum 120 into wash chamber 121. Ribs 126 assist with agitating articles disposed within wash chamber 121 during operation of washing machine appliance 100. For example, ribs 126 may lift articles disposed in drum 120 to top portion 146 of drum 120 during rotation of drum 120 and such articles may subsequently fall to bottom portion 148 of drum 120. Drum 120 also defines a plurality of holes 124. Holes 124 are configured to permit a flow of wash fluid and/or air between wash chamber 121 of drum 120 and tub 122. A detergent drawer 106 is slidably mounted within cabinet 102. Detergent drawer 106 receives detergent and directs the detergent to wash chamber 121 or tub 122 during operation of appliance 100. Detergent drawer 106 may further receive various additives as discussed herein and direct the additives to wash chamber 121 or tub 122 during operation of appliance 100.

Cabinet 102 of washing machine appliance defines an opening 105 that permits user access to wash chamber 121 of drum 120. A door 130 is mounted to cabinet 102 at opening 105 with a hinge 140. A window 136 in door 130 permits viewing of wash chamber 121 during operation of appliance 100. Door 130 also includes a handle 132 that, e.g., a user may pull when opening and closing door 130. Latch 134 is configured for selectively securing door 130 in a closed position.

A control panel 110 with a plurality of input selectors 112 is also mounted to cabinet 102. Control panel 110 and input selectors 112 collectively form a user interface for operator selection of machine cycles and features. A display 114 of control panel 130 indicates selected features, a countdown timer, and/or other items of interest to appliance users.

FIG. 2 provides a schematic view of one embodiment of washing machine appliance 100. As may be seen in FIG. 2, washing machine appliance 100 includes a cold water inlet 150 and a hot water inlet 152. Cold water inlet 150 is in fluid communication with a water source, such as a municipal water main or a well. Thus, cold water inlet 150 is configured for receipt of relatively cold water from the water source. A cold water conduit 154 extends between and fluidly connects cold water inlet 150 and detergent drawer 106. Thus, relatively cold water from cold water inlet 150 can flow through cold water conduit 154 to detergent drawer 106. Conversely, hot water inlet 152 is in fluid communication with a hot water source, such as a hot water heater. Thus, hot water inlet 152 is configured for receipt of relatively hot water from the hot water source. A hot water conduit 156 extends between and fluidly connects hot water inlet 152 and detergent drawer 106. Thus, relatively hot water from hot water inlet 152 can flow through hot water conduit 156 to detergent drawer 106. As will be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances.

An inlet conduit 158 extends between and fluidly connects detergent drawer 106 and drum 120 or tub 122. Thus, fluid within detergent drawer 106 can flow through inlet conduit 158 into wash chamber 121 of drum 120 or tub 122. As an example, a user can add detergent and an additive, such as bleach, fabric softener, other additives as discussed herein, etc., to detergent drawer 106. Water from cold water inlet 150 and/or hot water inlet 152 can flow into detergent drawer 106 and mix with fluid additive to form a wash fluid. Such wash fluid can flow through inlet conduit 158 into wash chamber 121 of drum 120 or tub 122 in order to assist with cleaning articles disposed within wash chamber 121.

Washing machine appliance 100 also includes a sump 160, e.g., positioned at bottom portion 148 of drum 120 or a bottom portion (not shown) of tub 122 positioned at or proximate bottom portion 148 of drum 120. Liquids within wash chamber 121 can collect within sump 160 during operation of washing machine appliance 100, e.g., due to gravity. A drain conduit 162 is configured for directing liquids out of sump 160. In particular, a drain pump 164 is configured for urging liquids out of sump 160 through drain conduit 162. Liquids within drain conduit 162 may be directed out of washing machine appliance 100, e.g., to a sewer or septic system or may be diverted from the drain by a recirculation (or circulation) pump 168, as described in more detail below. In particular, drain pump 164 can urge liquids within sump 160 out of washing machine appliance 100 through drain conduit 162. As an example, drain pump 164 can be activated during a drain cycle of washing machine appliance 100 in order to remove dirty or used wash fluid from sump 160. According to at least some embodiments, drain pump 164 and recirculation pump 168 are provided on a pump plenum 169. Accordingly, water from tub 122 may flow into pump plenum 169 before being diverted to one of drain pump 164 or recirculation pump 168. Additionally or alternatively, a separate, dedicated conduit may be used to direct fluid to drain pump 164 or recirculation pump 168.

A recirculation (or circulation) conduit 166, e.g., positioned at top portion 146 of drum 120 or a top portion (not shown) of tub 122 positioned at or proximate top portion 146 of drum 120, is configured for circulating fluids, e.g., wash liquor and/or sanitizing liquor, through washing machine appliance 100, e.g., through wash chamber 121 of drum 120 and/or tub 122. The recirculation conduit 166 may fluidly connect top portion 146 of drum 120 with sump 160. For example, the recirculation pump 168 may be configured for urging fluids out of wash chamber 121 of drum 120 and/or tub 122 through drain conduit 162 and back to the wash chamber 121 via recirculation conduit 166. The several components described herein may comprise a fluid circulation system of the washing machine appliance 100, e.g., the fluid circulation system of the washing machine appliance 100 may include the drain conduit 162, the recirculation pump 168, the recirculation conduit 166, the wash chamber 121, and the sump 160.

As an example, a user can load articles for washing into wash chamber 121, and the user can initiate washing operation through manipulation of input selectors 112 of control panel 110. Washing machine appliance 100, e.g., a controller thereof, then actuates cold water inlet 150 and/or hot water inlet 152 in order to fill drum 120 and/or tub 122 with water and/or detergent and additives to form a wash fluid in the manner discussed above. Once drum 120 and/or tub 122 is properly filled with wash fluid, the controller activates motor 142 in order to, for example, agitate the articles within wash chamber 121 with ribs 126 and assist with cleansing such articles.

After one or more agitation cycles of a wash cycle are completed, washing machine appliance 100 activates drain pump 164 to remove wash fluid from drum 120 and/or tub 122. Articles can then be rinsed by adding relatively clean fluid to drum 120 and/or tub 122 and, depending on the particulars of the cleaning cycle selected by a user, ribs 126 may again provide agitation within wash chamber 121. One or more spin cycles may also be used. In particular, a spin cycle may be applied after the wash cycle and/or after the rinse cycle in order to wring (e.g., extract) wash fluid from the articles being washed. During a spin cycle, drum 120 is rotated at relatively high speeds.

As mentioned, water can be supplied into drum 120 and/or tub 122 from cold water inlet 150 and/or hot water inlet 152. A volume of water, i.e., an amount of water that is provided into drum 120 and/or tub 122 during a single fill, can be a hot water volume and thus be at a hot temperature when flowed into the drum 120 and/or tub 122, or can be a warm water volume and thus be at a warm temperature when supplied into the drum 120 and/or tub 122, or can be a cold water volume and thus be at a cold temperature when supplied into the drum 120 and/or tub 122. A hot temperature, and thus the temperature of a hot water volume, may for example be between approximately 110 and approximately 130 degrees Fahrenheit, such as between approximately 115 and approximately 125 degrees Fahrenheit. A warm temperature, and thus the temperature of a warm water volume, may for example be between approximately 70 and approximately 105 degrees Fahrenheit, such as between approximately 75 and approximately 95 degrees Fahrenheit. A cold temperature, and thus the temperature of a cold water volume, may for example be between approximately 32 and approximately 100 degrees Fahrenheit, such as between approximately 35 and approximately 70 degrees Fahrenheit, such as between about 35 degrees Fahrenheit and about 60 degrees Fahrenheit. A cold water volume may be obtained through operation of the cold water inlet 150 to flow water therethrough while not operating the hot water inlet 152. A hot water volume may be obtained through operation of the hot water inlet 152 to flow water therethrough while not operating the cold water inlet 150. A warm water volume may be obtained through operation of the cold water inlet 150 and the hot water inlet 152 to flow water therethrough. Additionally, the temperatures of the water when flowed into the drum 120 and/or tub 122 are and remain the same or about the same as the temperatures used throughout the applicable cycle.

Figure 3:
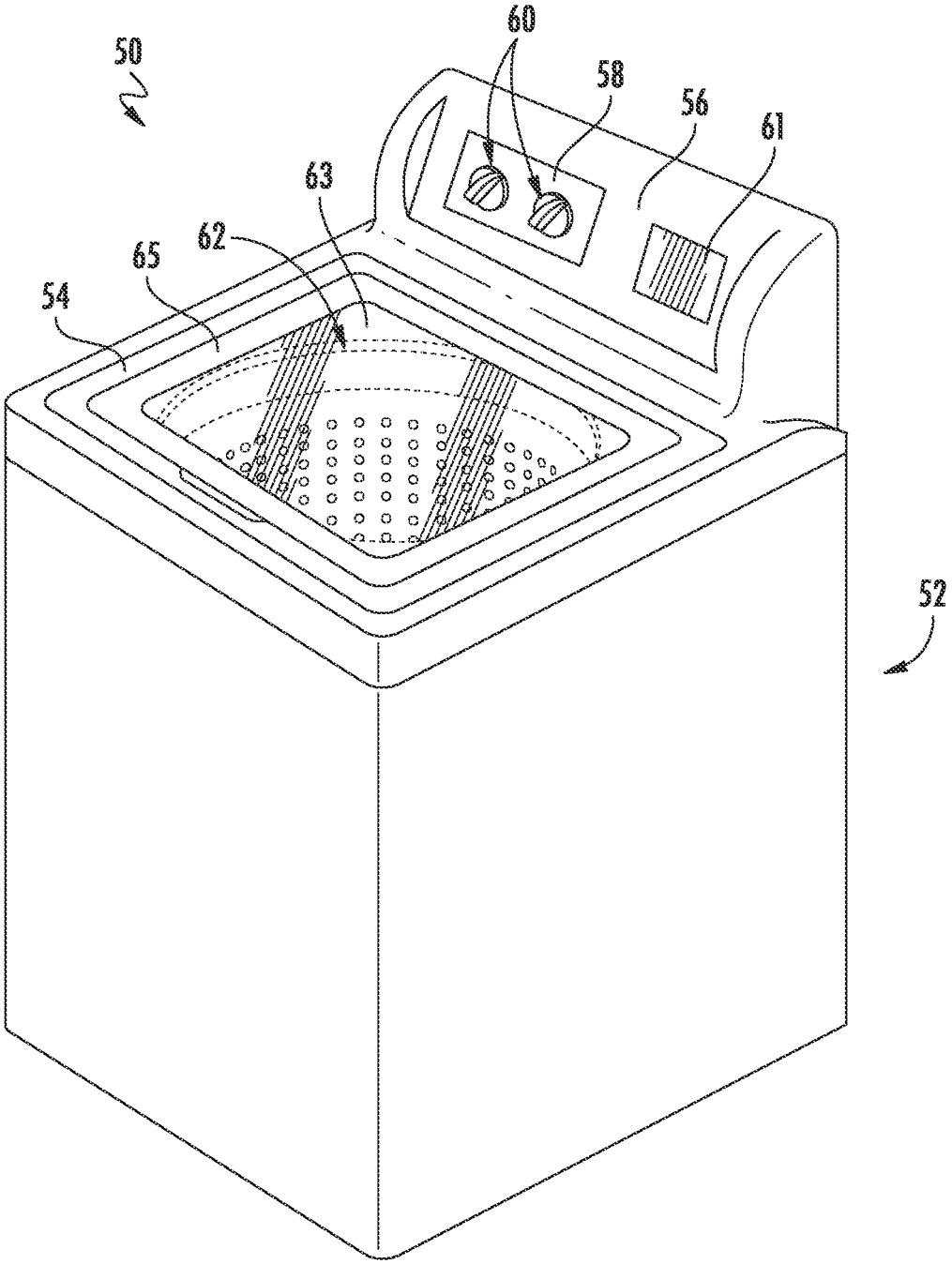
FIG. 3 provides a perspective view of a washing machine appliance according to one or more additional exemplary embodiments of the present disclosure.

FIG. 3 is a perspective view of a vertical axis top load washing machine appliance 50 according to an additional exemplary embodiment of the present subject matter. As may be seen in FIG. 3, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 4) located within cabinet 52 and a closed position (shown in FIG. 3) forming an enclosure over tub 64.

Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63. Alternatively, panel 63 need not be transparent.

Figure 4:
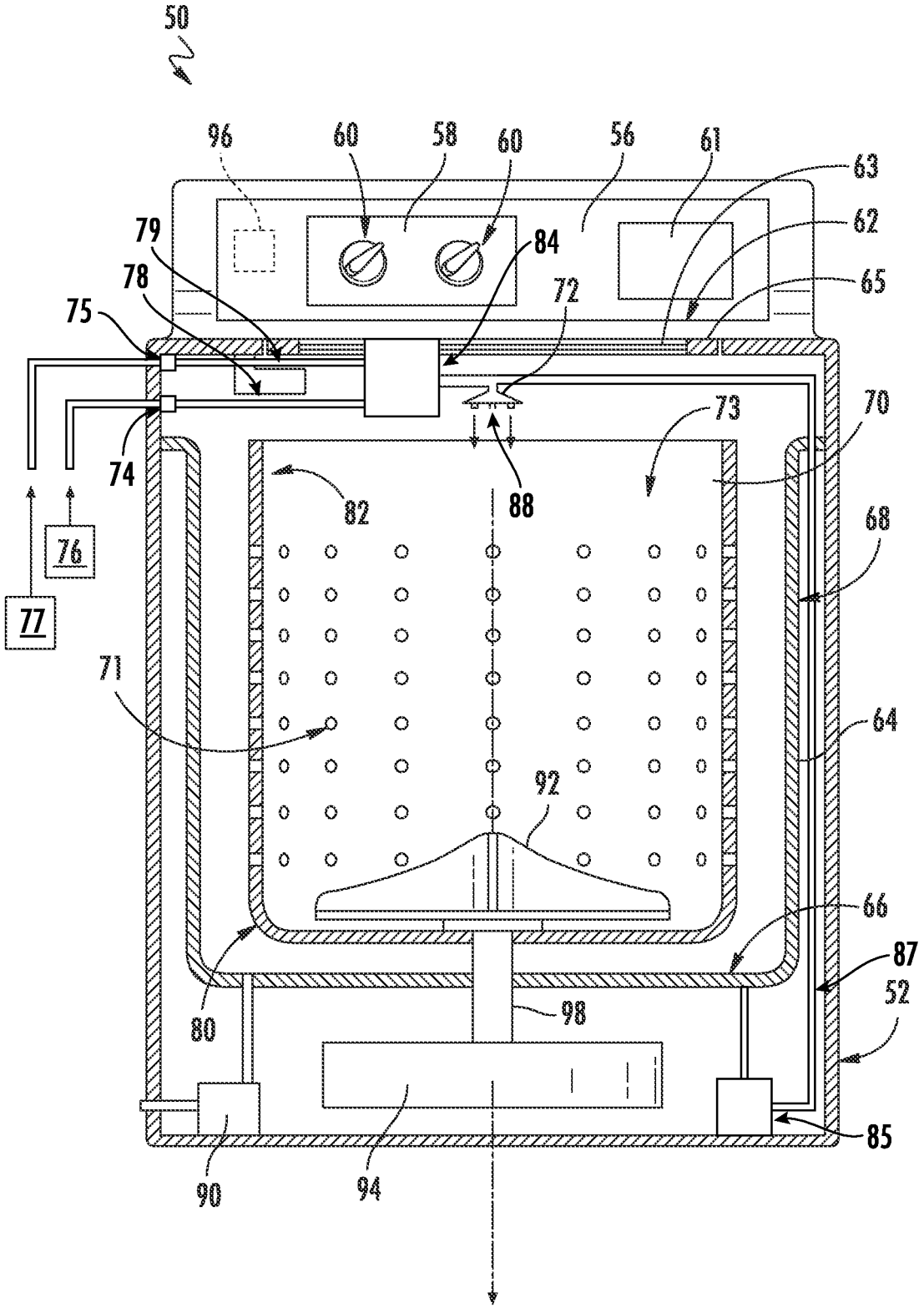
FIG. 4 provides a front, section view of the exemplary washing machine appliance of FIG. 3.

FIG. 4 provides a front, cross-section view of the exemplary washing machine appliance 50 of FIG. 3. As may be seen in FIG. 4, tub 64 includes a bottom wall 66 and a sidewall 68. A wash drum or wash basket 70 is rotatably mounted within tub 64. In particular, basket 70 is rotatable about a vertical axis V. Thus, washing machine appliance is generally referred to as a vertical axis (or top load) washing machine appliance. Basket 70 defines a wash chamber 73 for receipt of articles for washing and extends, e.g., vertically, between a bottom portion 80 and a top portion 82. Basket 70 may include a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent top portion 82 of basket 70. Nozzle 72 may be in fluid communication with one or more water sources 76, 77 in order to direct liquid (e.g. water) into tub 64 and/or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed, i.e. sprayed or poured, into the tub 64.

Various valves may regulate the flow of fluid through nozzle 72. For example, a flow regulator may be provided to control a flow of hot and/or cold water into the wash chamber of washing machine appliance 50. For the embodiment depicted, the flow regulator includes a hot water valve 74 and a cold water valve 75. The hot and cold water valves 74, 75 are utilized to flow hot water and cold water, respectively, therethrough. Each valve 74, 75 may selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial (e.g., municipal) water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric conditioner or softener, etc., into the tub 64. More particularly, as will be discussed below, additive dispenser 84 may be provided to direct a sanitizing additive into the tub 64. For example, dispenser 84 may be in fluid communication with nozzle 72 such that water flowing through nozzle 72 flows through dispenser 84, mixing with wash additive at a desired time during operation to form a wash liquor or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73.

A pump assembly 90 (shown schematically in FIG. 4) is located beneath tub 64 and basket 70 for gravity assisted flow to drain tub 64. Additionally or alternatively, a circulation pump (or recirculation pump) 85 may be provided. Circulation pump 85 may be provided separately from pump assembly 90. As shown in FIG. 4, for instance, circulation pump 85 may be fluidly connected to tub 64 via a separate conduit. A circulation (or recirculation) conduit 87 may extend from circulation pump 85 (e.g., toward nozzle 72). Accordingly, fluid from tub 64 may be recirculated back to nozzle 72 via circulation pump 85 and circulation conduit 87. For instance, controller 96 may drive circulation pump 85 to recirculate water (e.g., wash water with or without additive) from tub to nozzle after performing one or more cycles (e.g., an agitation cycle, a drain cycle, etc.).

Figure 5:
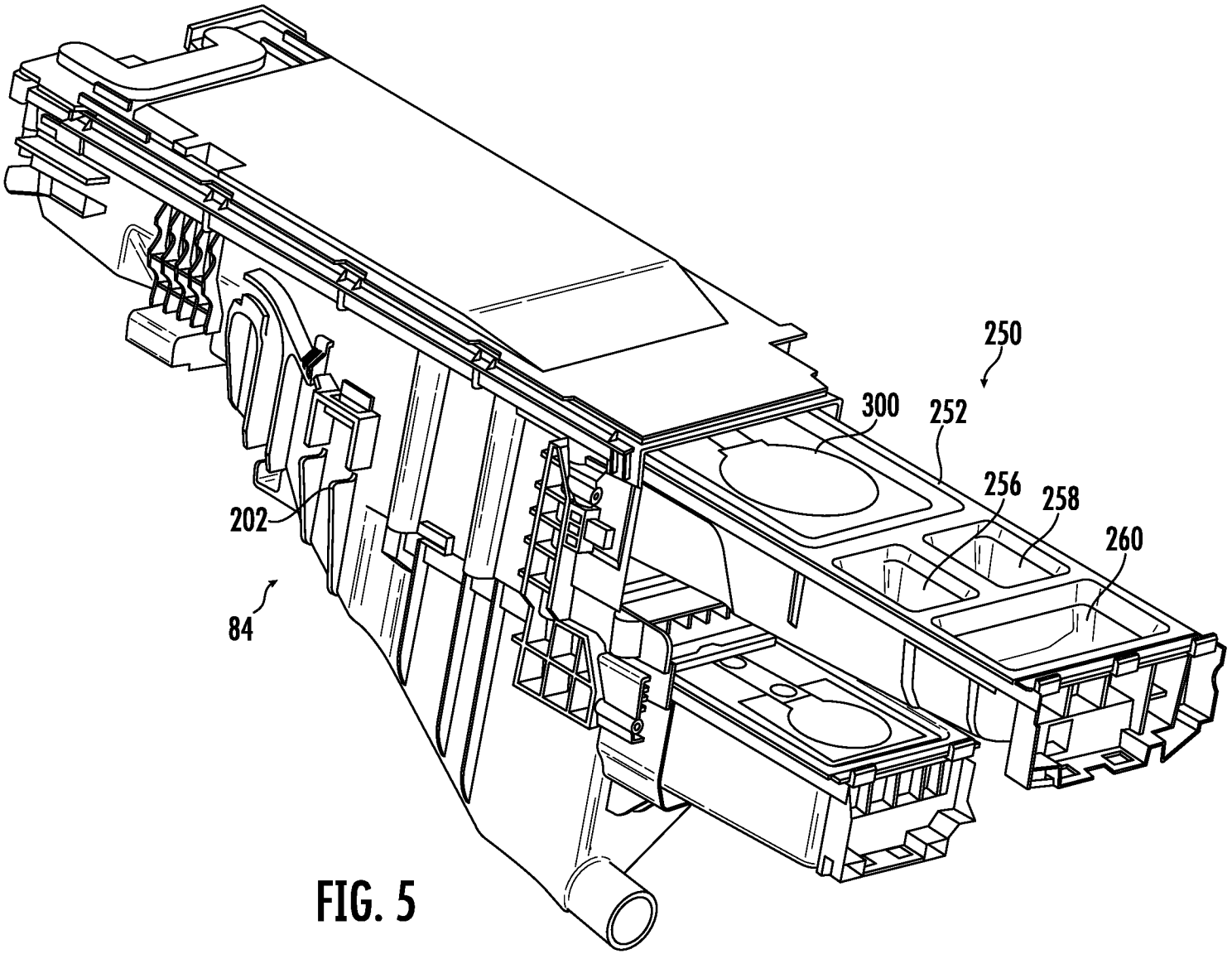
FIG. 5 provides a perspective view of an exemplary additive assembly according to one or more embodiments of the present disclosure.

Additive dispenser 84 (or detergent drawer 106) may include a dispenser body 202, as shown in FIG. 5. Dispenser body 202 may be in fluid communication with the wash tub (e.g., tub 64 or tub 122). For instance, a tube or pipe may connect dispenser body 202 to the wash tub. Water and/or one or more fluid additives may flow from dispenser body 202 through the tub supply conduit into the wash tub to perform a laundry operation.

The dispenser (e.g., additive dispenser 84 or detergent drawer 106) may include a first drawer 250 (or first drawer assembly) and a second drawer 280 (or second drawer assembly). Each of first drawer 250 and second drawer 280 may be slidably received within dispenser body 202. For instance, each of first drawer 250 and second drawer 280 may be selectively withdrawn from a front face of dispenser body 202 (e.g., along the transverse direction T). Thus, each of first drawer 250 and second drawer 280 may be movable between a withdrawn or extended position (e.g., as shown in FIG. 5) and a retracted position (e.g., retracted into dispenser body 202) along the transverse direction T.

In the withdrawn position, first drawer 250 and/or second drawer 280 may be at least partially withdrawn from dispenser body 202 so that a user may readily access one or more additive compartments of first drawer 250 or second drawer 280. e.g., to fill one of the compartments with an additive. In the retracted position, first drawer 250 and/or second drawer 280 is received within dispenser body 202, e.g., so that one or more of the additive compartments of first drawer 250 or second drawer 280 are in fluid communication with a water inlet valve and the wash tub during operation of the laundry treatment appliance.

Figure 6:
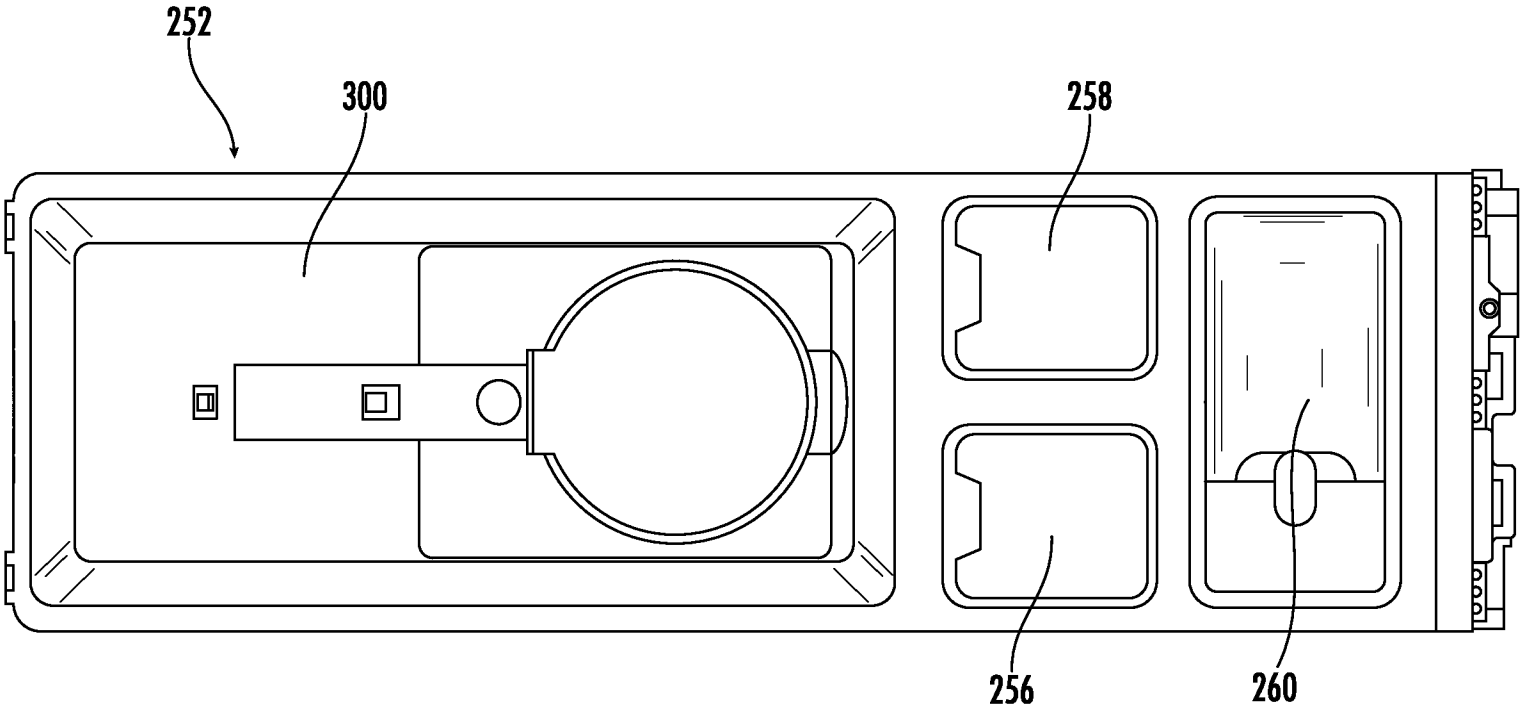
FIG. 6 provides a top view of an exemplary additive drawer of the additive assembly of FIG. 5.

First drawer 250 may include a first drawer body 252. First drawer body 252 may define a plurality of additive compartments or reservoirs. In particular, as shown best in FIG. 4, first drawer body 252 may define a first additive reservoir 256, a second additive reservoir 258, and a third additive reservoir 260. First additive reservoir 256 and second additive reservoir 258 may have similar shapes and volumes, e.g., as shown in FIG. 6. Third additive reservoir 260 may be defined within first drawer body 252 in front of first additive reservoir 256 and second additive reservoir 258, e.g., along the transverse direction T. Third additive reservoir 260 may be positioned generally along a front of first drawer body 252. In alternative embodiments, the additive reservoirs may have other suitable configurations and may be configured to receive different additives (e.g., such as a sanitization additive).

As shown in FIG. 6, first drawer body 252 may include a first tank 300 configured to receive a fluid additive, such as e.g., a liquid detergent. In detail, first tank 300 may be nested within first drawer body 252. First tank 300 may be spaced from first additive reservoir 256 and second additive reservoir 258, e.g., along the transverse direction T. For instance, first tank 300 may be provided behind the additive reservoirs along the transverse direction T. In some embodiments, first tank 300 is not in liquid communication with first additive reservoir 256, second additive reservoir 258, or third additive reservoir 260. Access to first tank 300 may be provided by an access member (or door), which may be rotatably hinged to a top wall of first tank 300 (or a top of first drawer body 252) as shown in FIG. 6. In alternative exemplary embodiments, the access member may be other suitable types of members that provide selective access to first tank 300. For instance, the access member may be a sliding door that slides along the transverse direction T to provide selective access to first tank 300.

First tank 300 may be sized to appropriately accommodate any suitable amount of fluid additive. The large (e.g., bulk) capacity of first tank 300 may allow a user to run a multitude or plurality of wash cycles without need to refill the tank after each cycle. This may, for example, reduce a user's manual efforts of pouring, measuring, and filling the tank for a particular laundry load. For example, a user may execute wash cycles under normal conditions for two to four (2-4) months without need to refill first tank 300 with a new supply of fluid additive.

An agitation element 92, shown as an impeller in FIG. 4, may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 4, agitation element 92 is oriented to rotate about vertical axis V. Alternatively, basket 70 may provide such agitating movement, and agitation element 92 is not required. Basket 70 and agitation element 92 are driven by a motor 94, such as a pancake motor. As motor output shaft 98 is rotated, basket 70 and agitation element 92 are operated for rotatable movement within tub 64, e.g., about vertical axis V. It should be appreciated, however, that in other exemplary embodiments, the exemplary washing machine appliance 50 may not include an agitation element 92, and instead wash machine appliance 50 may agitate articles positioned within wash chamber 73 by, e.g., rotating basket 70. Washing machine appliance 50 may also include a brake assembly (not shown) selectively applied or released for respectively maintaining basket 70 in a stationary position within tub 64 or for allowing basket 70 to spin within tub 64.

According to at least some embodiments, agitation element 92 include an agitation post (not shown). For instance, the agitation post may extend (e.g., along vertical axis V) from agitation element 92 (e.g., toward lid 62). The agitation post may form a hollow receiving area therein defined downward along the vertical axis V. A cup assembly may be selectively received within the receiving area of the agitation post. For instance, the cup assembly may be removably inserted into the receiving area along the vertical axis V. The cup assembly may be referred to as an additive cup assembly. Accordingly, the cup assembly may selectively receive, store, or disperse an additive (e.g., liquid additive) to wash chamber 73 during a washing operation (e.g., such as fabric softener).

Operation of washing machine appliance 50 may be controlled by a processing device or controller 96, that is operatively coupled to the input selectors 60 located on washing machine backsplash 56 for user manipulation to select washing machine cycles and features. Controller 96 may further be operatively coupled to various other components of appliance 50, such as the valves 74, 75, motor 94, and various sensors, etc. In response to user manipulation of the input selectors 60, controller 96 may operate the various components of washing machine appliance 50 to execute selected machine cycles and features.

Controller 96 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 96 via one or more signal lines or shared communication busses. It should be noted that controllers 96 as disclosed herein are capable of and may be operable to perform any methods and associated method steps as disclosed herein.

While described in the context of specific embodiments of washing machine appliance 50 and 100, using the teachings disclosed herein it will be understood that washing machine appliances 50 and 100 are provided by way of example only. Other washing machine appliances having different configurations, different appearances, and/or different features may also be utilized with the present subject matter as well.

Figure 7:
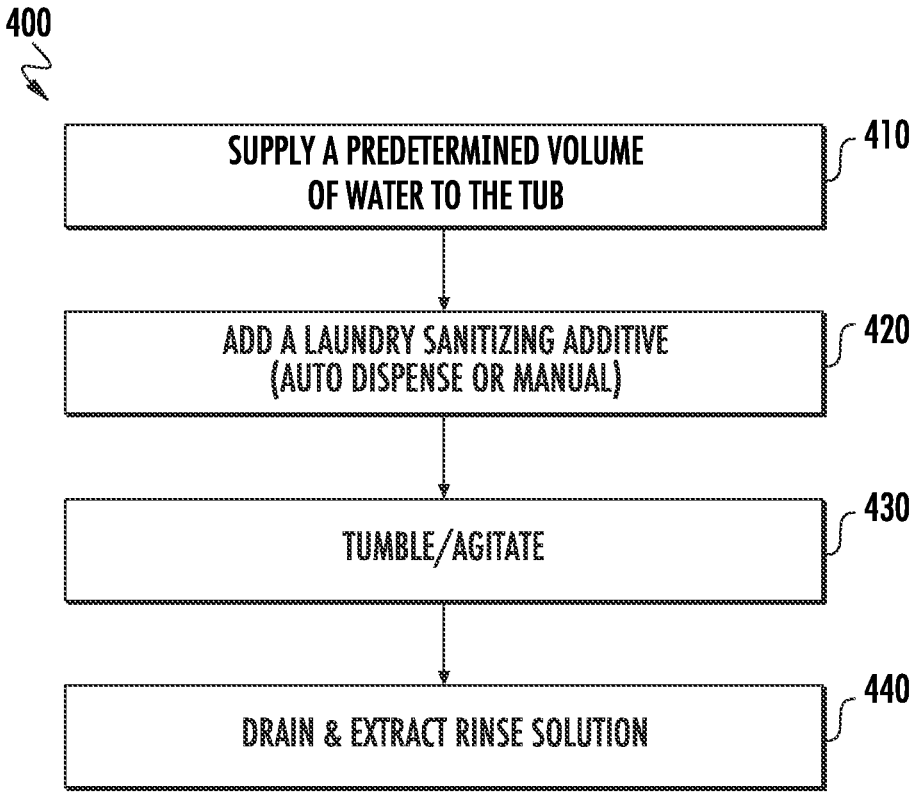
FIG. 7 provides a flowchart illustrating an exemplary method of operating a washing machine appliance in accordance with one or more exemplary embodiments of the present disclosure.
Figure 8:
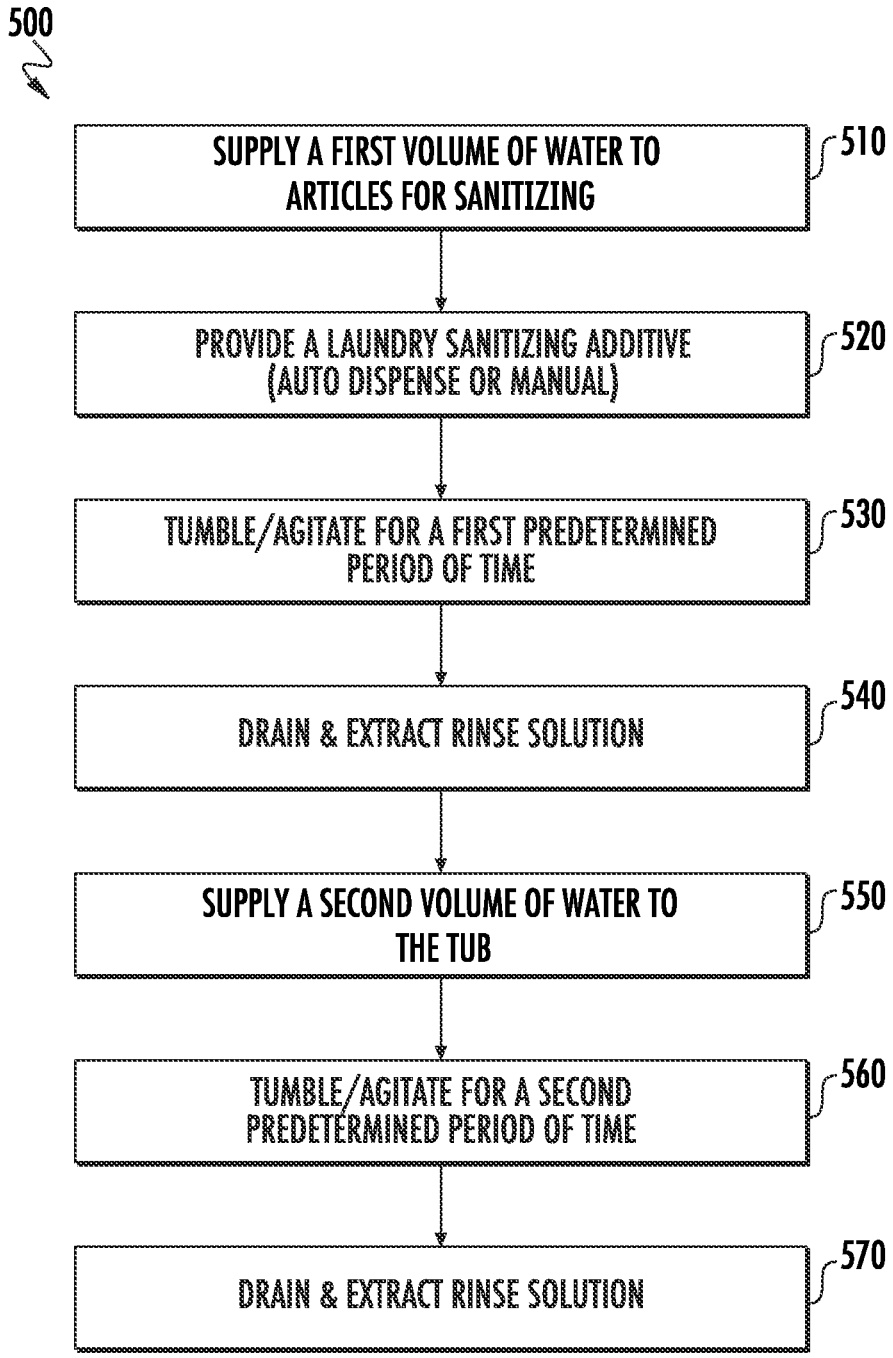
FIG. 8 provides a flowchart illustrating an exemplary method of operating a washing machine appliance in accordance with one or more additional exemplary embodiments of the present disclosure.

FIGS. 7 and 8 illustrate exemplary methods 400 and 500 for operating a washing machine appliance according to exemplary embodiments of the present subject matter. Such methods can advantageously provide improved washing machine appliance operation when sanitization of articles is required, by for example, advantageously requiring only the use of cold (e.g., tap cold) water or warm water for sanitization, which reduces or eliminates the risk of color of fabric damage typically associated with thermal sanitization and/or harsh additives such as bleach. In exemplary embodiments, a controller of the washing machine appliance (e.g., controller 96 as illustrated in FIG. 4) can generally be programmed to implement such methods, and thus may be configured to perform the various steps thereof. As described in more detail below, methods 400 and 500 may include performing a rinse cycle. In some embodiments, the rinse cycle may be a portion of an overall cycle or operation of the washing machine appliance. For example, the method 400 or 500 may also include performing a wash cycle prior to the rinse cycle. In some embodiments, upon completion of the method 400 or 500, the overall wash cycle may end. After the method 400 or 500 is complete, the washing machine appliance and articles therein may be sanitized as a result of the method 400 or 500.

Turning specifically to FIG. 7, the method 400 may, in some embodiments, include, for example, the step 410 of filling the tub with a first predetermined volume of water (e.g., to a predetermined fill level). The predetermined fill level is a total liquid level within the tub. The predetermined fill level may for example be dependent upon the article volume size, and thus for example may be based on the weight of the articles in the tub. For example, the predetermined fill level may be between approximately 0.5 and approximately 3.0 gallons per pound of articles within the tub, such as between approximately 1.0 and approximately 2.5 gallons per pound of articles within the tub, such as between approximately 1.5 and approximately 2.0 gallons per pound of articles within the tub. In at least some embodiments, the method 400 may be a single-rinse sanitization method. For example, the method 400 may be a single-rinse method in that the rinse volume of step 410 may be the only volume of water supplied to the tub or otherwise used in the tub during the entire rinse cycle. As another example, the rinse volume of step 410 may be one of two rinse volumes with which the tub is filled during the entire rinse cycle. Such embodiments of method 400, where the first predetermined volume of water is the only rinse volume or one of two rinse volumes, may be particularly suited for a top load (vertical axis) washing machine appliance, such as the example washing machine appliance 50 illustrated in FIGS. 3 and 4. In various embodiments the rinse volume, or all of the rinse volumes where more than one is provided, is/are at a temperature of between about 33 degrees Fahrenheit and about 100 degrees Fahrenheit throughout the duration of the rinse cycle.

The first volume of water may be supplied to the tub in a plurality of ways. For instance, the first volume of water may be sufficient to submerge (e.g., completely or entirely) the washing articles in the water. The submersion may be referred to as a deep fill, for instance. The submersion may be a volume of water such that every washing article is covered with the volume of water. Additionally or alternatively, the first volume of water may be a partial submersion. The partial submersion may be such that a predetermined percentage of the washing articles are submerged in the water, while at least a portion are not submerged. The partial submersion may be any suitable percentage of submersion (e.g., 20%, 50%, 70%, etc.).

Further still, the first volume of water may be supplied as a sprayed mist or shower (e.g., via a nozzle which distributes the flow volume of water over the wash articles). In detail, the first volume of water may be supplied into the tub via a water supply provide above (e.g., along the vertical direction) the washing articles. Accordingly, the first volume of water may be said to be "sprayed" onto the washing articles. The spray supply of water may include one or more additives therein (e.g., the sanitizing additive). For instance, the spray supply of water may be performed as the wash basket or drum is being rotated. The rotation of the wash basket may be an agitation motion (e.g., within a vertical axis or top load washing machine), a tumble motion (e.g., within a horizontal axis or front load washing machine), a general spin motion, or the like. For instance, within the vertical axis washing machine, the rotation of the wash basket may be in a clockwise direction, a counterclockwise direction, or may alternate between the clockwise direction and the counterclockwise direction. Thus, the first volume of water may be supplied to the tub (e.g., to the washing articles within the tub) in one of multiple ways or methods to initiate saturation of the washing articles.

Method 400 may further include a step 420 of adding a predetermined volume of sanitizing additive to the tub. The predetermined volume of sanitizing additive may be between about two milliliters per liter and about 50 milliliters per liter (2-50 mL/L) of the predetermined first volume of water. The sanitizing additive may be provided concurrently with the first volume of water (e.g., steps 410 and 420 may be performed simultaneously). In additional or alternative embodiments, the sanitizing additive is supplied after the first volume of water has been supplied to the tub. The sanitizing additive may be provided at step 420 in any suitable manner. For example, in some exemplary embodiments, the sanitizing additive may be provided through a dispenser assembly, such as dispenser 84 or detergent drawer 106 described above, or alternatively may be provided directly to the wash chamber by, e.g., a user. For one example, a user selects one of a plurality of additive cups (e.g., within detergent drawer 106) into which to supply the sanitizing additive. The assigned cup from the plurality of cups may then be assigned to the sanitizing additive within the rinse operation. In other words, the user may provide an input assigning one of the plurality of cups to the sanitizing additive. The method 400 may then acknowledged the assigned cup and initiate the supply of the sanitizing agent via the assigned cup (e.g., by providing a water supply through the assigned cup and into the tub).

According to at least some embodiments, the method 400 allows for a user to provide manual inputs to adjust one or more phases of the washing operation. For instance, the user may (e.g., via a remotely connected mobile device) adjust one or more parameters of the washing operation. Accordingly, a sanitization phase may be incorporated into the washing operation. Thus, in assigning one of the plurality of cups to the sanitizing additive, the washing operation may be adjusted to eliminate a previously programmed phase and replace the eliminated phase with the sanitizing phase. Additionally or alternatively, a time length (described further below) may be adjusted (e.g., via an app on the remotely connected mobile device). Advantageously, the washing machine allows for modularity in designing certain laundry cycles (e.g., full wash cycles incorporating a sanitization rinse, independent sanitization rinse cycles, etc.).

After filling the tub with the first predetermined volume of water and adding the volume of sanitizing additive to the tub, the method 400 may include a step 430 of performing an agitation cycle for a predetermined time period. The first predetermined volume of water and the sanitizing additive may be mixed during the agitation cycle to form a sanitizing liquor. The method 400 may provide cold sanitizing. The sanitizing liquor may be at or about the same temperature as the first volume of water (e.g., between about 33 degrees Fahrenheit and about 100 degrees Fahrenheit), for example, the sanitizing liquor may not be heated and the sanitizing process may otherwise not include adding thermal energy to the wash chamber and/or articles therein.

The agitation cycle generally agitates the articles and wash fluid, including the first predetermined volume of water and sanitizing additive, within the tub (e.g., to mix the sanitizing liquor and uniformly saturate the wash articles within the sanitizing liquor). In exemplary embodiments, such step 430 may include rotating a drum of the washing machine appliance in the agitation cycle (e.g., in alternating rotational directions for a front load washing machine appliance). Step 430 may, additionally or alternatively, include reversible rotation of an agitation element relative to drum (e.g., for a top load washing machine appliance). Such rotation of the drum and/or agitation element may include various steps of rotating and/or holding stationary to allow articles within the wash chamber to soak within the sanitizing liquor. For example, the agitation cycle may include rotating for a rotation period and holding stationary for a soak period. The combination of the rotation period and the soak period may be referred to as an operating duty cycle. For instance, the operating duty cycle may include a percentage of rotational agitation time over a total rotational and hold (olr dwell) time. The operating duty cycle (e.g., for agitation) may be between about 10% and about 90% (e.g., of the agitation cycle). Accordingly, the agitation cycle may be between about 5 minutes and about 20 minutes. The rotations of the drum and/or agitation element may be performed at any suitable speeds. For example, the reversible rotation of the agitation element (e.g., within the top load washing machine appliance) may be performed between approximately 75 revolutions per minute ("RPM") and approximately 200 RPM, such as between approximately 90 RPM and approximately 140 RPM, such as between approximately 110 RPM and approximately 130 RPM. As another example, rotation of the drum (e.g., within a front load washing machine appliance) may be performed between approximately 3 RPM and approximately 75 RPM, such as between approximately 5 RPM and approximately 60 RPM, such as between approximately 10 RPM and approximately 45 RPM. Such rotation and holding may be repeated as required, and repeated rotations may occur in opposite directions, such as clockwise, then counterclockwise, then clockwise, etc. Further, additional or alternative patterns of rotation (at any suitable speeds) and/or holding may be utilized in an agitation cycle as desired or required.

In some embodiments, e.g., when a recirculation (or circulation) pump is provided, the wash fluid and/or sanitizing liquor may be recirculated within the washing machine appliance, e.g., by activating the recirculation pump. Such recirculation may advantageously provide fabric wetting and additive mixing, as well as sanitization of the fluid circulation system of the washing machine appliance. For example, recirculation may be provided during the agitation cycle, or at least a portion of the agitation cycle. The portion of the agitation cycle may be about 75% of the agitation cycle or more, such as about 80% of the agitation cycle or more, such as about 90% of the agitation cycle or more, such as about 95% of the agitation cycle. The portion of the agitation cycle may be an initial portion of the agitation cycle, for example, recirculation may be provided during the first 90% of the agitation cycle.

As discussed, the agitation cycle may be performed for a predetermined time period. In various exemplary embodiments, the predetermined time period may be between approximately 8 minutes and approximately 30 minutes, such as between approximately 15 and approximately 25 minutes, such as about 16 minutes or about 20 minutes. In some embodiments, the predetermined time period for performing the agitation cycle may be at least about fifteen (15) minutes.

In additional or alternative embodiments, method 400 may include supplying an additional additive to the tub. For instance, after performing the agitation cycle, a second additive may be supplied to the tub. The second additive may be the same as or different from the first additive. In some embodiments, the second additive is a fabric softener. Moreover, additional water may be supplied to the tub in conjunction with the second additive. For instance, a second volume of water may be supplied to the tub with the second additive (e.g., to form a third volume of water within the tub). Optionally, the second additive and second volume of water may be supplied to the tub before performing a drain cycle or extraction cycle.

Method 400 may further include step 440 of draining the sanitizing liquor from the tub after performing the agitation cycle and performing an extraction cycle after draining the sanitizing liquor from the tub. Drain conduit 162 and drain pump 164 may, for example, be utilized to drain such water, etc. as discussed above. The extraction cycle may extract wash fluid, e.g., water and/or additives such as detergent, sanitizing additive, etc., from the articles within the wash chamber. Rotation of the drum in the extraction cycle may occur for example at a speed between approximately 300 RPM and approximately 1500 RPM, such as between approximately 800 RPM and approximately 1200 RPM. The extraction cycle may be performed for a predetermined period of time, such as between about eight minutes and about sixteen minutes.

In some embodiments, the first predetermined volume of water of step 410 may be a first cold water rinse volume, and method 400 may also include filling the tub with a second predetermined volume of water (e.g., to a second predetermined fill level). In such embodiments, the method 400 may further include adding a volume of a second additive. For example, the second additive may be a fabric conditioner or softener. In embodiments which include the second predetermined volume of water and the second additive, filling the tub with the second predetermined volume of water and adding the volume of the second additive may be performed after performing the extraction cycle.

The agent concentration, e.g., the ratio of the volume of sanitizing additive to the cold water rinse volume in step 420 above, and the exposure time, e.g., the total duration of the agitation cycle in step 430 described above, may vary to achieve sanitization efficacy based on the chemical composition of the sanitizing additive. For instance, some sanitization additives may be supplied at a concentration of between about 1 mL/L and about 10 mL/L, while other sanitization additives may be supplied at a concentration of between about 2 mL/L and about 6 mL/L. Additionally or alternatively, higher concentrations of the sanitization additive or additives may be used (e.g., to achieve higher levels of microbiological reduction). For instance, the sanitization additives may, in certain embodiments, be supplied at concentrations of between about 40 mL/L and about 60 mL/L.

Turning now to FIG. 8, the method 500 may, in some exemplary embodiments, include a step 510 of filling the tub with a first volume of water (e.g., to a first predetermined fill level). The first predetermined fill level may be a total liquid level within the tub. The first predetermined fill level may for example be dependent upon the article volume size, and thus for example may be based on the weight of the articles in the tub. For example, the first predetermined fill level may be between approximately 0.5 and approximately 3.0 gallons per pound of articles within the tub, such as between approximately 1.0 and approximately 2.5 gallons per pound of articles within the tub, such as between approximately 1.5 and approximately 2.0 gallons per pound of articles within the tub.

In at least some embodiments, method 500 may be a multi-rinse sanitization method. For example, method 500 may be a multi-rinse method in that the method 500 may further include a second volume of water, as described in more detail below. Multi-rinse sanitation methods such as method 500 may be particularly suited for a front load (horizontal axis) washing machine appliance, such as the example washing machine appliance 100 illustrated in FIGS. 1 and 2. In various embodiments, all of the rinse volumes are at a temperature between about 33 degrees Fahrenheit and about 100 degrees Fahrenheit throughout the duration of the rinse cycle, e.g., the rinse volumes comprise water flowed into the tub without excessive heating and the tub is filled with such water, e.g., the water is not heated after filling the tub.

Method 500 may further include a step 520 of adding a volume of sanitizing additive to the tub. The volume of sanitizing additive may be between about one milliliter and about 60 milliliters per liter (1-60 mL/L, as described above) of the first volume of water. The sanitizing additive may be provided at step 520 in any suitable manner. For example, in some exemplary embodiments, the sanitizing additive may be provided through a dispenser assembly, such as dispenser 84 or detergent drawer 106 described above, or alternatively may be provided directly to the wash chamber by, e.g., a user.

For instance, the method 500 (and/or method 400) may include a step of emitting, via a user interface of the washing machine appliance or the remotely connected mobile device, a prompt to manually add the sanitizing additive to the tub. The prompt may be emitted after supplying the first volume of water to the tub (e.g., to the articles for washing provided within the tub). In some instances, the prompt is emitted at the initiation of the sanitization rinse phase (e.g., as the first volume of water is being supplied to the tub). The prompt may be a visual alert, an audible alert, or a combination of one or more alerts.

After filling the tub with the first cold water rinse volume and adding the volume of sanitizing additive to the tub, method 500 may include a step 530 of performing a first agitation cycle for a first predetermined time period. The first cold water rinse volume and the sanitizing additive may be mixed during the first agitation cycle to form a sanitizing liquor. The method 500 may provide cold sanitizing. The sanitizing liquor may be at or about the same temperature as the first cold water rinse, e.g., the sanitizing liquor may not be heated and the sanitizing process may otherwise not include adding thermal energy to the wash chamber and/or articles therein.

The first agitation cycle generally agitates the articles and wash fluid, including the first cold water rinse volume and sanitizing additive, within the tub (e.g., to mix the sanitization liquor and uniformly saturate the wash articles in the sanitizing liquor within a front load washing machine appliance). In exemplary embodiments, step 530 may include rotating a drum of the washing machine appliance (e.g., in alternating rotational directions) in the first agitation cycle. Step 530 may, additionally or alternatively, include rotating an agitation element relative to drum (e.g., within a top load washing machine appliance). Such rotation of the drum and/or agitation element may include various steps of rotating and/or holding stationary to allow articles within the wash chamber to soak within the sanitizing liquor. A combination of the rotating period (e.g., of the drum and/or the agitation element) and a soak period may be referred to as the operating duty cycle. The operating duty cycle may be a percentage of the rotation agitation time over a total rotation and hold (or dwell) time. The operating duty cycle (e.g., for the agitation) may be between about 10% and about 90%. For instance, the agitation period may be between about 5 minutes and about 20 minutes. The agitation profile for the front load washing machine appliance may include a duration of the rotational on time and an off (or hold) time (e.g., in each rotational direction).

For example, the first agitation cycle may include rotating for a rotation period of between approximately 5 seconds and approximately 20 seconds, such as between approximately 10 seconds and approximately 15 seconds, and may further include holding stationary for a soak period of between approximately 2 seconds and approximately 10 seconds, such as between approximately 2 seconds and approximately 6 seconds. The rotations of the drum and/or agitation element may be performed at any suitable speeds, such as for example between approximately 30 revolutions per minute ("RPM") and approximately 60 RPM, such as between approximately 40 RPM and approximately 50 RPM. Such rotation and holding may be repeated as required, and repeated rotations may occur in opposite directions, such as clockwise, then counterclockwise, then clockwise, etc. Further, additional or alternative patterns of rotation (at any suitable speeds) and/or holding may be utilized in an agitation cycle as desired or required.

In some embodiments, e.g., when a recirculation (or circulation) pump is provided, the wash fluid and/or sanitizing liquor may be recirculated within the washing machine appliance, e.g., by activating the recirculation pump. Such recirculation may advantageously provide fabric wetting and additive mixing, as well as sanitization of the fluid circulation system of the washing machine appliance. For example, recirculation may be provided during the first agitation cycle, or at least a portion of the first agitation cycle. The portion of the first agitation cycle may be about 75% of the first agitation cycle or more, such as about 80% of the first agitation cycle or more, such as about 90% of the first agitation cycle or more, such as about 95% of the first agitation cycle. The portion of the first agitation cycle may be an initial portion of the first agitation cycle, for example, recirculation may be provided during the first 90% of the first agitation cycle.

As discussed, the first agitation cycle may be performed for a first predetermined time period. In various exemplary embodiments, the first predetermined time period may be between approximately 5 minutes and approximately 30 minutes, such as between approximately 15 and approximately 25 minutes, such as about 16 minutes or about 20 minutes. In some embodiments, the first predetermined time period for performing the first agitation cycle may be at least about fifteen (15) minutes.

Method 500 may further include step 540 of draining the sanitizing liquor from the tub after performing the first agitation cycle and performing a first extraction cycle after draining the sanitizing liquor from the tub. Drain conduit 162 and drain pump 164 may, for example, be utilized to drain such water, etc. as discussed above. The first extraction cycle may extract wash fluid, e.g., water and/or additives such as detergent, sanitizing additive, etc., from the articles within the wash chamber. Rotation of the drum in the first extraction cycle may occur for example at a speed between approximately 300 RPM and approximately 1500 RPM, such as between approximately 800 RPM and approximately 1200 RPM. The first extraction cycle may be performed for a predetermined period of time, such as between about eight minutes and about sixteen minutes.

Additionally or alternatively, step 540 may be omitted. For instance, after agitating for the first predetermined time period, method 500 may include supplying an additional additive to the tub without performing a drain and extract from the tub. According to such instances, method 500 may, after supplying the additional additive to the tub, proceed to step 550. According to still further embodiments, method 500 may, after supplying the additional additive to the tub, proceed to step 560. For instance, after adding the additional additive to the tub, method 500 may perform a second agitation cycle without adding additional water. The additional additive may be additional sanitizing additive, fabric conditioner additive, or the like.

Method 500 may further include step 550 of filling the tub with a second volume of water (e.g., to a second predetermined fill level). The second predetermined fill level may be about the same as the first predetermined fill level. For example, the second predetermined fill level may be between about one gallon of cold water per pound of fabric and about two and a half gallons of cold water per pound of fabric.

After filling the tub with the second volume of water, method 500 may further include step 560 of performing a second agitation cycle for a second predetermined time period. In some embodiments, method 500 may also include adding a volume of a second additive, such as a fabric softener, after filling the tub with the second volume of water, e.g., after performing the first extraction cycle, and before the second agitation cycle. The second predetermined time period for the second agitation cycle may be less than the first predetermined time period. For example, the second predetermined time period may be between about one minute and about five minutes, such as about three minutes.

Method 500 may also include step 570 of draining the second volume of water from the tub after performing the second agitation cycle and performing a second extraction cycle after draining the second volume of water from the tub. Draining the second volume of water may be performed in substantially the same manner as draining the first volume of water (e.g., the sanitizing liquor), as described above. The second extraction cycle may be performed in substantially the same manner as the first extraction cycle, as described above.

In some embodiments, method 500 may also include a pre-rinse prior to filling the tub with the first volume of water. For example, the pre-rinse may include, prior to filling the tub with the first volume of water, filling the tub with a pre-rinse cold water volume, performing a pre-rinse agitation cycle, and draining the pre-rinse cold water volume from the tub after the pre-rinse agitation cycle. For example, the pre-rinse agitation cycle prior to the filling the tub with the first volume of water may be performed for a predetermined period of time, such as between about five minutes and about ten minutes, such as between about seven minutes and about nine minutes.

The agent concentration, e.g., the ratio of the volume of sanitizing additive to the first predetermined volume of water in step 520 above, and the exposure time, e.g., the total duration of the agitation cycle in step 530 described above, may vary to achieve sanitization efficacy based on the chemical composition of the sanitizing additive.

According to additional or alternative embodiments, the sanitizing rinse operation may be performed before a wash operation is performed. In detail, the sanitizing additive may be added to wash articles within the tub together with water. The sanitizing agitation cycle (described above) may then be performed, followed by the drain and extraction cycles. A prewash operation may be performed after the sanitizing rinse operation is performed. For instance, the prewash operation may be an additional water rinse of the wash articles before a standard wash operation is performed. The prewash operation may thus include supplying a predetermined volume of water to the tub after performing a sanitizing extraction cycle, performing a prewash agitation cycle to further rinse any lingering sanitizing additive from the wash articles, and performing a prewash drain cycle and extraction cycle prior to initiating the standard washing operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a control operated washing machine appliance, the washing machine appliance having a drum positioned within a tub, the drum defining a wash chamber for receipt of articles for sanitizing, and an additive dispenser comprising a plurality of additive reservoirs, the method comprising:

determining that a sanitization rinse operation is selected;

receiving an input assigning one of the plurality of additive reservoirs to the sanitization rinse operation; and performing the sanitization rinse operation, the sanitization rinse operation comprising:

supplying a first volume of water to the articles for sanitizing within the tub at a temperature of between 33 degrees Fahrenheit and 100 degrees Fahrenheit;

adding a sanitizing additive to the tub, the sanitizing additive being added concurrently with or after providing the first volume of water to the tub to create a concentration of sanitizing additive within the first volume of water;

performing a first agitation cycle for a first predetermined time period after providing the first volume of water and adding the sanitizing additive to the tub, wherein the first volume of water and the sanitizing additive are mixed during the first agitation cycle to form a sanitizing liquor;

supplying an additional additive to the tub after performing the first agitation cycle;

performing a second agitation cycle after supplying the additional additive to the tub;

draining the tub after performing the second agitation cycle; and performing an extraction cycle after draining the tub.

2. The method of claim 1, wherein supplying the first volume of water to the articles for sanitizing comprises at least one of a partial submersion of the articles for sanitizing in the first volume of water, a total submersion of the articles for sanitizing in the first volume of water, or a spray distribution of the first volume of water over the articles for sanitizing via a circulation pump.

3. The method of claim 1, further comprising:

supplying a second volume of water to the tub in conjunction with supplying the additional additive to the tub.

4. The method of claim 1, further comprising activating a recirculation pump during at least a portion of the first agitation cycle whereby the recirculation pump circulates the sanitizing liquor within a fluid distribution system of the washing machine appliance during at least a portion of the first agitation cycle.

5. The method of claim 1, further comprising:

emitting, via a user interface of the washing machine appliance or a remotely connected mobile device, a prompt to manually add the sanitizing additive to the tub after supplying the first volume of water to the articles for sanitizing within the tub.

6. The method of claim 1, wherein the first predetermined time period for performing the first sanitization rinse operation is twenty minutes or less.

7. The method of claim 1, wherein the concentration of sanitizing additive is between about one milliliter and about six milliliters per liter of the first volume of water.

8. The method of claim 1, further comprising performing a wash cycle prior to the rinse operation.

9. The method of claim 1, further comprising, prior to filling the tub with the first volume of water, filling the tub with a pre-rinse water volume, performing a pre-rinse agitation cycle, and draining the pre-rinse water volume from the tub after the pre-rinse agitation cycle.

10. A method of operating a washing machine appliance, the washing machine appliance having a drum positioned within a tub, the drum defining a wash chamber for receipt of articles for washing and sanitizing, and an additive dispenser comprising a plurality of additive reservoirs, the method comprising:

determining that a sanitization rinse operation is selected;

receiving an input assigning one of the plurality of additive reservoirs to the sanitization rinse operation;

performing the sanitization rinse operation, the sanitization rinse operation comprising:

supplying a first predetermined volume of water to the tub via a spray pattern from a water supply;

adding a predetermined volume of sanitizing additive to the tub to create a predetermined concentration of sanitizing additive within the first predetermined volume of water, the predetermined concentration being between 2 milliliters and 50 milliliters of sanitizing additive per liter of water;

performing a first agitation cycle for a predetermined time period after filling the tub with the first predetermined volume of water and adding the predetermined volume of sanitizing additive to the tub, wherein the predetermined volume of water and the predetermined volume of sanitizing additive are mixed during the first agitation cycle to form a sanitizing liquor;

draining the sanitizing liquor from the tub after performing the first agitation cycle; and performing an extraction cycle after draining the sanitizing liquor from the tub;

whereby the washing machine appliance and articles therein are sanitized; and performing a dilution rinse operation following the sanitization rinse operation, the dilution rinse operation comprising:

supplying a second predetermined volume of water to the tub;

performing a second agitation cycle for a predetermined time period;

draining the second predetermined volume of water from the tub after performing the second agitation cycle; and performing an extraction cycle after draining the second predetermined volume of water from the tub.

11. The method of claim 10, further comprising activating a recirculation pump during at least a portion of the agitation cycle whereby the recirculation pump circulates the sanitizing liquor within a fluid distribution system of the washing machine appliance during at least a portion of the agitation cycle.

12. The method of claim 10, wherein the predetermined volume of water is between one half gallon and two gallons per pound of articles in the wash chamber.

13. The method of claim 10, wherein the predetermined concentration of sanitizing additive is between one milliliters and six milliliters per liter of water.

14. The method of claim 10, wherein the predetermined time period for performing the sanitization rinse operation is twenty minutes or less.

15. The method of claim 10, further comprising performing a wash cycle prior to the rinse cycle.

16. The method of claim 10, wherein the predetermined volume of water is supplied at a temperature of between 33 degrees Fahrenheit and 100 degrees Fahrenheit.

17. A method of operating a washing machine appliance, the washing machine appliance having a drum positioned within a tub, the drum defining a wash chamber for receipt of articles for washing and sanitizing, and an additive dispenser comprising a plurality of additive reservoirs, the method comprising:

determining that a sanitization rinse operation is selected;

receiving an input assigning one of the plurality of additive reservoirs to the sanitization rinse operation;

performing the sanitization rinse operation, the sanitization rinse operation comprising:

supplying a first predetermined volume of water to the tub via a spray pattern from a water supply;

adding a predetermined volume of sanitizing additive to the tub to create a predetermined concentration of sanitizing additive within the first predetermined volume of water, the predetermined concentration being between 2 milliliters and 50 milliliters of sanitizing additive per liter of water;

performing a first agitation cycle for a predetermined time period after filling the tub with the first predetermined volume of water and adding the predetermined volume of sanitizing additive to the tub, wherein the predetermined volume of water and the predetermined volume of sanitizing additive are mixed for a duration of 20 minutes or less during the first agitation cycle to form a sanitizing liquor;

draining the sanitizing liquor from the tub after performing the first agitation cycle; and performing a sanitizing extraction cycle after draining the sanitizing liquor from the tub; whereby the washing machine appliance and articles therein are sanitized; and performing a wash operation after performing the sanitization rinse operation, wherein performing the wash operation comprises:

supplying water and detergent to the tub after performing the extraction cycle;

performing a wash agitation cycle after supplying the water and detergent to the tub;

draining the water and detergent from the tub;

performing a wash extraction cycle after draining the water and detergent from the tub; and performing one or more rinse operations after performing the wash extraction cycle.

18. The method of claim 17, further comprising:

supplying a prewash volume of water to the tub after performing the sanitizing extraction cycle and prior to supplying the water and detergent to the tub;

performing a prewash agitation cycle after supplying the prewash volume of water to the tub;

draining the prewash volume of water from the tub after performing the prewash agitation cycle; and performing a prewash extraction cycle after draining the prewash volume of water from the tub.

* * * * *